US005695923A

United States Patent [19]

Irving et al.

[11] Patent Number: 5,695,923

[45] Date of Patent: Dec. 9, 1997

[54] RADIATION-SENSITIVE SILVER HALIDE GRAINS INTERNALLY CONTAINING A DISCONTINUOUS CRYSTAL PHASE

[75] Inventors: Mark Edward Irving, Rochester; Donald Lee Black, Webster, both of N.Y.

[73] Assignee: Eastman Kodak Company, Rochester, N.Y.

[21] Appl. No.: 707,814

[22] Filed: Aug. 30, 1996

[51] Int. Cl.[6] ..... G03C 1/035

[52] U.S. Cl. ..... 430/567

[58] Field of Search ..... 430/567

[56] References Cited

U.S. PATENT DOCUMENTS

| | | | |
|---|---|---|---|
| 4,094,684 | 6/1978 | Maskasky . | |
| 4,184,878 | 1/1980 | Maternaghan | 430/567 |
| 4,614,711 | 9/1986 | Sugimoto et al. | 430/567 |
| 4,672,026 | 6/1987 | Daubendiek | 430/495 |
| 5,061,609 | 10/1991 | Piggin et al. | 430/569 |
| 5,132,203 | 7/1992 | Bell et al. | 430/567 |
| 5,238,804 | 8/1993 | Maskasky et al. | 430/567 |
| 5,288,603 | 2/1994 | Maskasky et al. | 430/567 |
| 5,604,086 | 2/1997 | Reed et al. | 430/567 |

FOREIGN PATENT DOCUMENTS

| | | | |
|---|---|---|---|
| 4224027 A1 | 7/1992 | Germany | G03C 1/015 |

OTHER PUBLICATIONS

James, *The Theory of Photographic Process*, pp. 1–5.

*Primary Examiner*—Mark F. Huff
*Attorney, Agent, or Firm*—Carl O. Thomas

[57] ABSTRACT

A photographic emulsion is disclosed in which radiation-sensitive silver halide grains are present containing (a) a continuous silver halide phase of a face centered cubic rock salt crystal lattice structure and (b) a discontinuous phase in the form of discrete islands separated by and surrounded by the continuous phase, each of the islands exhibiting a silver iodide crystal lattice structure.

7 Claims, 3 Drawing Sheets

RADIATION-SENSITIVE SILVER HALIDE GRAINS INTERNALLY CONTAINING A DISCONTINUOUS CRYSTAL PHASE

FIELD OF THE INVENTION

The invention relates to radiation-sensitive silver halide emulsions useful in photography.

DEFINITION OF TERMS

The symbol "μm" is used to represent micrometer(s).

The symbol "M%" is used to designate mole percent.

In referring to silver halide emulsions, grains or grain regions containing two or more halides, the halides are named in order of ascending concentrations (see James *The Theory of the Photographic Process,* 4th Ed., Macmillan, New York, 1977, p. 4).

The term "high iodide" refers to silver halide grains and grain regions containing greater than 90 mole percent iodide, based on total silver forming the grains or grain regions.

The terms "silver iodide crystal phase" and "silver iodide crystal structure" refer to the crystal structures of silver iodide and high iodide silver halide grains and grain regions.

The term "limited iodide" refers to silver halide grains and grain regions that are limited in the concentrations of iodide they can contain by reason of a face centered cubic rock salt (FCCRS) crystal lattice structure of the silver halide grains or grain regions.

The term "high bromide" refers to limited iodide silver halide grains and grain regions that contain a higher molar percentage (M%) of bromide than chloride.

The term "tabular grain" refers to a grain having an aspect ratio of at least 2, where aspect ratio is the ratio of grain equivalent circular diameter (ECD) to grain thickness.

The term "tabular grain emulsion" refers to an emulsion in which greater than 50 percent of total grain projected area is accounted for by tabular grains.

*Research Disclosure* is published by Kenneth Mason Publications, Ltd., Dudley House, 12 North St., Emsworth, Hampshire P010 7DQ, England.

BACKGROUND

Photographic silver halide emulsions contain radiation-sensitive microcrystals, commonly referred to as grains.

Radiation-sensitive grains which consist essentially of silver iodide, bromide or chloride, with no other halide being present are each known. Radiation-sensitive grains containing mixtures of halides in their crystal structure are also known. However, the range of halide combinations that can exist within a crystal structure is limited, since silver iodide favors different crystal habits than silver bromide or chloride.

Figure 1:
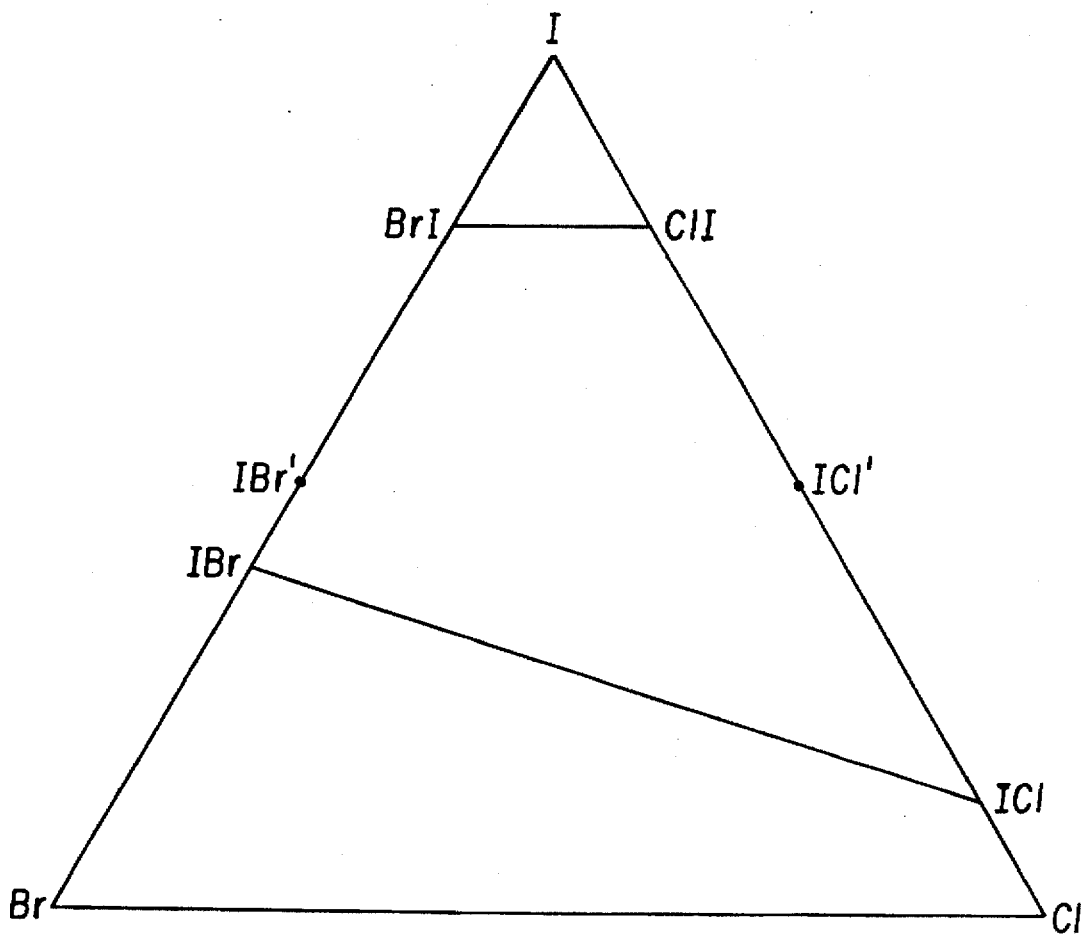
FIG. 1 is a phase diagram showing all theoretically possible choices of halides in radiation-sensitive silver halide grains. The silver halide consists of 100 mole percent Cl, Br and I, based on silver, at points Cl, Br and I, respectively. At any selected intermediate point along axes Cl-Br, Cl-I and Br-I the silver halide consists of mixtures of the two halides used to name the axis. At all other locations within the diagram, three halides are present. In reality, many of the proportions of halides shown as theoretically possible cannot co-exist in a single crystal phase.

Silver chloride and silver bromide each form an FCCRS crystal lattice structure. These crystal structures can consist of silver ions and (a) bromide ions as the sole halide ions, (b) chloride ions as the sole halide ions, or (c) mixtures of chloride and bromide ions in all proportions. Thus, all possible combinations along the Br-Cl axis in FIG. 1 are known in silver halide grain structures. The crystal structures differ solely by their unit cell dimensions, which are a reflection of the differing sizes of chloride and bromide ions.

Silver iodide exhibits an FCCRS crystal lattice structure only at very high pressure levels (3,000 to 4,000 times atmospheric pressure). This form of silver iodide, referred to as σ phase silver iodide, has no relevance to silver halide photography. The silver iodide crystal structure that is most stable under ambient conditions is the hexagonal wurtzite type, commonly referred to as β phase silver iodide. A second silver iodide crystal lattice structure also sufficiently stable to be photographically useful is silver iodide of a face centered cubic zinc-blende crystal structure, commonly referred to as γ phase silver iodide. Silver iodide emulsions have been prepared containing each of β phase and γ phase crystal structures as well as mixtures of these phases. A fourth crystallographic form of silver iodide is α phase, a body centered cubic crystal structure, which is stated by James, *The Theory of Photographic Process,* cited above, page 1, to require a temperature of 146° C. for its formation, but it is believed that the "bright yellow" silver iodide reported by Daubendiek U.S. Pat. No. 4,672,026 is, in fact, α phase silver iodide. (James, pp. 1–5, are relevant to this and following portions of this discussion.)

In considering mixtures of bromide and/or chloride ions with iodide ions in a silver halide grain crystal structure, there are two possible conditions to consider: (1) how much bromide and/or chloride ion can be tolerated in a silver iodide crystal lattice structure and (2) how much iodide ion can be tolerated in a silver bromide and/or chloride crystal lattice structure—i.e., an FCCRS crystal lattice structure.

Addressing (1), silver iodide crystal lattice structures are typically identified as containing greater than 90 mole percent iodide, based on total silver, and, therefore, only minor amounts of bromide and/or chloride. Referring to FIG. 1, silver iodide crystal lattice structures can contain the halide compositions falling within the triangular boundaries defined by BrI, I and ClI. Maternaghan U.S. Pat. No. 4,184,878 is illustrative of a high iodide silver halide emulsion.

High iodide silver halide grains have a significant advantage over FCCRS crystal lattice structure silver halide grains in that the former exhibit higher native absorption in the short (400 to 450 nm) blue region of the spectrum. Specifically, high iodide silver halide exhibits an absorption peak at about 425 nm that is absent from silver halides of differing crystal structures.

Unfortunately, high iodide silver halide grains also exhibit disadvantages that more than offset their advantages. High iodide silver halide grains are difficult to sensitize efficiently and are difficult to develop with commercial developers. This has drastically curtained their use as latent image-forming silver halide grains.

The overwhelming majority of iodide containing emulsions satisfy condition (2), wherein iodide concentrations are limited by the solubility of iodide ion in an FCCRS crystal lattice structure. A maximum of about 13 mole percent iodide, based on total silver, can be accomodated in a silver iodochloride FCCRS crystal lattice structure, shown as ICl in FIG. 1, while a maximum of about 40 mole percent iodide, based on total silver, shown as IBr in FIG. 1, can be accomodated in a silver iodobromide FCCRS crystal lattice structure. The points Br, IBr, ICl and Cl then define the boundaries of the limited iodide silver halide compositions that can be accomodated within a silver halide FCCRS crystal lattice structure. The most extensively used photographic emulsions are those relying for latent image formation on radiation-sensitive high bromide silver halide grains in which iodide is a minor halide component.

The upper limit (saturation level) of iodide in a silver halide FCCRS crystal lattice structure varies slightly (within a few percentage points), depending upon the exact conditions chosen for emulsion preparation. Maskasky U.S. Pat. Nos. 5,238,804 and 5,288,603 (hereinafter collectively referred to as Maskasky I) suggest incorporating iodide at concentrations of up to 50 mole percent, based on silver, by conducting precipitation under higher than ambient pressures to permit increased temperatures of precipitation. In fact, silver halide is conventionally precipitated at ambient pressures, and the Maskasky I preparation processes, though demonstrated in part, have never been practically applied. Thus, although the upper iodide boundary of silver halide FCCRS crystal lattice structure might be raised to extend between IBr' and ICl' according to Maskasky I, the approximate practical upper limit accepted by the art is defined by IBr and ICl.

Limited iodide FCCRS crystal lattice structure silver halide grains can exhibit high levels of imaging efficiency and have therefore found widespread use in photographic emulsions. These grains, however, show limited native blue absorption. Additionally, the presence of iodide at the surface of the grains adversely affects developability. It is therefore a common practice to limit overall and surface concentrations of iodide in these silver halide grains far below the iodide solubility limit. Specific illustrations of limiting surface iodide concentrations are provided by Piggin et al U.S. Pat. No. 5,061,609 and Bell et al U.S. Pat. No. 5,132,203. In many emulsion precipitations a thin shell of AgBr is precipitated after the completion of AgIBr precipitation in a final step of adjusting the pAg (or pBr) of the emulsion (sometimes also referred to as a silver overrun, since the adjustment takes place by closing the halide addition jet and continuing briefly to add silver ion, which reacts with the stoichiometric excess of bromide ion in the dispersing medium).

It has been proposed from time to time to combine a high iodide phase with a limited iodide phase within a single silver halide grain. For example, Maskasky U.S. Pat. No. 4,094,684 (Maskasky II) discloses precipitating silver chloride epitaxially on a silver iodide host grain. The problem with discrete epitaxial deposits is that the high iodide phase still forms a portion of the composite grain surface and still interferes with sensitization and development.

Sugimoto et al U.S. Pat. No. 4,614,711 recognized the problem of having high iodide concentrations at the surface of silver halide grains and therefore proposed to construct grains with a core, a first shell and a surface shell, with maximum iodide concentrations being located in the first shell. Sugimoto et al recognized that the iodide concentration of the first shell could range to 100 mole percent, based on silver forming the first shell, and indicated at least 40 mole percent iodide to be preferred. Thus, the formation of a first shell of a high iodide silver halide composition was specifically contemplated.

Sugimoto et al describes first shell formation in broad terms that suggest virtually any common silver halide precipitation technique would be effective to achieve subsurface shell formation (including, but not limited to, high iodide crystal lattice structures). The comparative Examples below demonstrate failures to obtain a high iodide phase following the teachings of Sugimoto et al.

However, even if a high iodide first shell could be formed by one skilled in the art, based on the undemonstrated teaching of Sugimoto et al, locating the first shell at a sub-surface location does not eliminate iodide interference with grain development, but merely delays development being arrested until developer has penetrated to the surface of the first shell of the grains. The silver halide forming the surface shell is well utilized, but a high iodide silver halide sub-surface shell necessarily creates a development barrier that interferes with utilization of silver halide forming the core portion of the grains.

Karthhäuser German OLS 4,224,027 A1 is directed to a process for the preparation of a tabular grain silver iodobromide emulsion comprised of a silver iodobromide core having an iodide content of at least 2.5M % and a first shell surrounding the core having an iodide content which is at the lower limit of the mixing gap (i.e., at IBr on the Br-I axis in FIG. 1) and at least one additional shell of low iodide content. Karthhäuser is thus similar to Sugimoto et al, but less pertinent, in that the iodide composition of the subsurface shell is explicitly limited to the upper solubility limit of iodide ion in the FCCRS crystal lattice structure formed by silver iodobromide. A comparison emulsion in the Examples below prepared according to the teachings of Karthhäuser failed to demonstrate a silver iodide crystal lattice structure (i.e., a high iodide phase).

RELATED APPLICATION

Reed et al U.S. Ser. No. 08/620,773, filed Mar. 22, 1996, now U.S. Pat. No. 5,604,086, commonly assigned, titled TABULAR GRAIN EMULSIONS CONTAINING A RESTRICTED HIGH IODIDE SURFACE PHASE, discloses a photographic element comprised of a dispersing medium and radiation-sensitive silver halide grains with greater than 50 percent of total grain projected area being accounted for by grains containing a tabular host portion of an FCCRS crystal lattice structure and an epitaxial phase containing greater than 90 mole percent iodide restricted to a portion of the surface of the tabular host portion.

SUMMARY OF THE INVENTION

It has been discovered quite unexpectedly that the increased short blue absorption that a high iodide phase provides can be realized as well as other advantages, including enhanced imaging efficiency, while maintaining the favorable development characteristics of limited iodide silver halide grain structures.

The present invention ideally positions a silver iodide crystal phase within a limited iodide silver halide crystal phase to obtain the overall performance advantages of each of these phases and to produce a composite grain structure that provides an overall improvement in photographic properties.

In one aspect this invention is directed to a photographic emulsion comprised of a dispersing medium and silver halide grains wherein, at least half of total silver forming the grains is accounted for by radiation-sensitive silver halide grains containing (a) a continuous silver halide phase of a face centered cubic rock salt crystal lattice structure and (b) a discontinuous phase in the form of discrete islands separated by and surrounded by the continuous phase, each of the islands exhibiting a silver iodide crystal lattice structure.

DESCRIPTION OF PREFERRED EMBODIMENTS

This invention is directed to a photographic emulsion comprised of a dispersing medium and silver halide grains. At least half of total silver forming the grains is accounted for by radiation-sensitive silver halide grains containing (a) a continuous silver halide phase of a face centered cubic rock salt (FCCRS) crystal lattice structure and (b) a discontinuous phase in the form of discrete islands separated by and surrounded by the continuous phase, each of the islands exhibiting a silver iodide crystal lattice structure.

Figure 2:
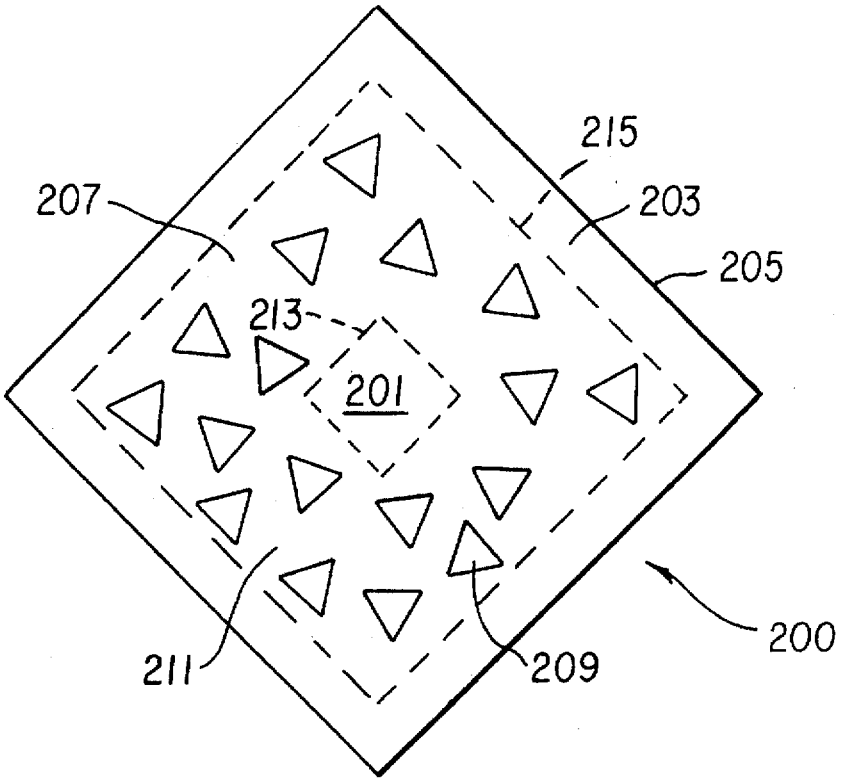
FIG. 2 is a schematic sectional view of a nontabular silver halide grain satisfying the requirements of the invention.

In FIG. 2 a sectional schematic view of a nontabular grain 200 is shown. The grain contains a core portion 201 formed of an FCCRS crystal lattice structure. The grain also contains a surface shell 203 of an FCCRS crystal lattice structure forming the external surface 205 of the grain. Interposed between the core and the surface shell of the grain is a mixed phase zone 207. The mixed phase zone consists of a discontinuous phase of a silver iodide crystal lattice structure present in the form of discrete islands 209 and a continuous phase 211 of an FCCRS crystal lattice structure.

For ease of visualization a boundary 213 is shown between the core and mixed phase zone, and a boundary 215 is shown between the mixed phase zone and the surface shell. In fact, no distinct boundary exists at these locations, since, in practice, the crystal lattice structures of the core, the continuous phase of the mixed phase zone, and the surface shell all form part of a continuous FCCRS crystal lattice structure. The compositions of the core, continuous phase and surface shell can be identical or independently adjusted.

Although grain 200 is schematically shown as a regular grain, the grains can take any desired regular or irregular form. The grains can, for example, be regular grains, such as cubic, octahedral, tetradecahedral or rhombic dodecahedral grains. Alternatively, the grains can be irregular (that is, containing internal stacking faults, such as one or more twin planes or screw dislocations). Common examples of irregular grains are multiply twinned grains (sometimes descriptively referred to as lumpy or potato grains) and tabular grains (containing two or more parallel twin planes).

Figure 3:
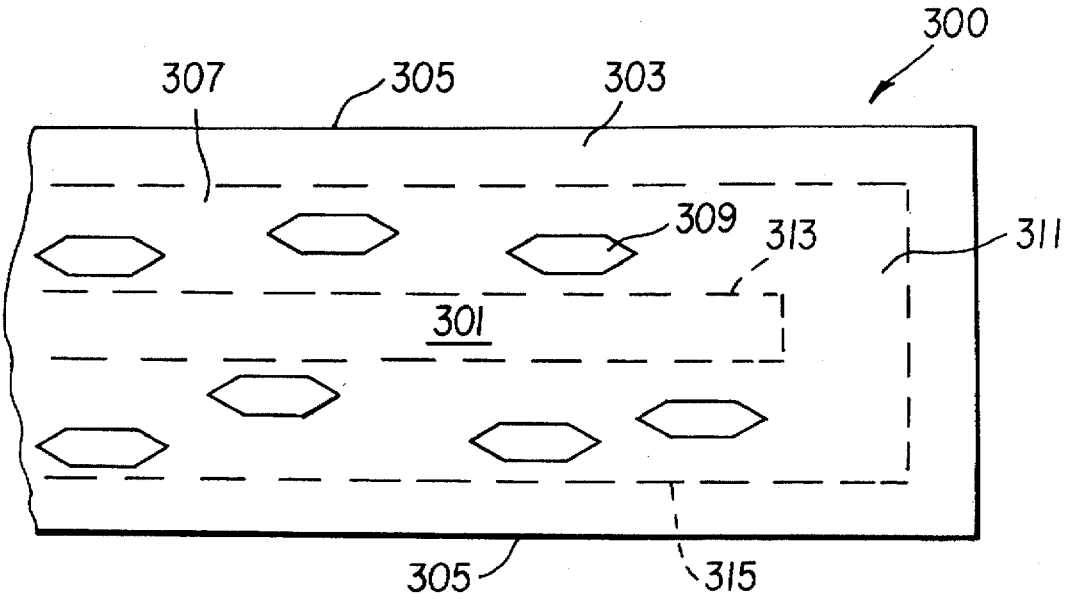
FIG. 3 is a schematic sectional fragmentary view of a tabular silver halide grain satisfying the requirements of the invention.

In FIG. 3 a sectional schematic view of a portion of a tabular grain 300 is shown. The grain contains a core portion 301 formed of an FCCRS crystal lattice structure. The core portion contains at least two parallel twin planes, not shown. The grain contains a surface shell 303 of an FCCRS crystal lattice structure forming the external major faces 305 of the grain. Interposed between the core and the surface shell of the grain is a mixed phase zone 307. The mixed phase zone consists of a discontinuous phase of a silver iodide crystal lattice structure present in the form of discrete islands 309 and a continuous phase 311 of an FCCRS crystal lattice structure.

For ease of visualization a boundary 313 is shown between the core and mixed phase zone, and a boundary 315 is shown between the mixed phase zone and the surface shell. In fact, no distinct boundary exists at these locations, since, in practice, the crystal lattice structures of the core, the continuous phase of the mixed phase zone, and the surface shell all form part of a continuous FCCRS crystal lattice structure. The compositions of the core, continuous phase and surface shell can be identical or independently adjusted.

The sole function of the core portion of the nontabular grains is to provide grain nuclei to act as deposition sites for silver halide being precipitated to form the mixed phase zone. If it is attempted to form the mixed phase zone in the absence of previously formed grain nuclei, precipitation is adversely biased toward the simultaneous creation of two separate grain populations, one consisting of a silver iodide crystal structure, and the other consisting of an FCCRS crystal structure.

In the precipitation of nontabular grains, the core portions of the grains can account for a very small percentage of total silver forming the grains—e.g., as little as 0.1 percent of total silver. Preferably the core portion accounts for from 2 to 40 percent of total silver.

In forming the tabular grains the core portion performs the same functions as in the precipitation of the nontabular grains and, in addition, is relied upon to provide tabular grains as a substrate for subsequent precipitation. The percent of total silver forming the core portion of a tabular grain can be as low as 1 percent, based on total silver. However, it is generally more convenient to utilize a somewhat higher percentage of total silver in forming the core portions of tabular grains, since the core portions must be grown until two or more twin planes can be incorporated to insure a tabular crystal habit. Preferably the core portion of the tabular grains accounts for from 2 to 60 percent of total silver. Most preferably the core portions of tabular grains are contemplated to contain from about 5 to 50 percent of total silver.

The function of the surface shell is to space the mixed phase zone and, particularly, the high iodide islands of the mixed phase zone from the surface of the grains, thereby minimizing iodide ion release to the developer solution at the outset of development (which is known to slow development rates). Any thickness of the surface shell that can provide a continuous barrier between the mixed phase zone and the developer solution can be employed. A minimum average surface shell thickness of 25 Å, preferably at least 50 Å, is recognized in the art to be capable of performing this function. To minimize iodide concentrations at the surface of the shell attributable to iodide penetration from the mixed phase zone, it is preferred that the shell account for at least 30 percent of total silver. The shell can account for as much as 80 or even 90 percent of total silver, where the lowest attainable surface iodide concentrations are sought.

The mixed phase zone accounts for the balance of the silver not present in the central portion and surface shell grain structure. Short blue absorption by the grains increases as the percentage of total silver formed by the mixed phase zone increases. The mixed phase zone preferably accounts for at least 5 (most preferably at least 10) percent of total silver forming the grains. Preferably the mixed phase zone accounts for up to 70 percent, most preferably up to 50 percent, of total silver.

Precipitations of the core portion and the surface shell of the grain structure can be accomplished by conventional techniques for precipitating limited iodide grain structures and requires no detailed description. A general summary of silver halide precipitation is contained in *Research Disclsure,* Vol. 365, September 1994, Item 36544, I. Emulsion grains and their preparation, particularly C. Preparation procedures.

To form the mixed phase grain portion a combination of conditions must be satisfied. First, concurrently with silver ion addition, a mixture of halide ions must be present in the dispersing medium (i.e., the aqueous phase) within the reaction vessel that cannot be entirely accomodated in a high iodide crystal lattice structure or a limited iodide crystal lattice structure. For example, assuming under the conditions of precipitation that BrI-ClI in FIG. 1 defines the saturation limit of bromide and/or chloride in the high iodide crystal lattice and IBr-ICl similarly defines the saturation level of silver iodide in the limited iodide crystal lattice, the composition of halide ions introduced during precipitation of the mixed phase zone is within the quadrangle having as its apices IBr, BrI, ClI and ICl.

As precipitation forming the mixed phase zone occurs, two different types of crystal lattice structures are formed. An FCCRS limited iodide crystal lattice (hereinafter also referred to as phase I) is formed as a continuous phase. The composition of the limited iodide phase lies along the axis IBr-ICl, the exact composition depending upon whether only one of bromide and chloride are introduced or, if both are introduced, in what molar proportions. Simultaneously discrete islands are formed in the continuous phase. The discrete islands (hereinafter also referred to as phase II) exhibit a silver iodide crystal lattice structure having a high iodide composition lying along axis BrI-ClI. Again, the exact composition of the high iodide phase depends upon whether only one of bromide and chloride are present during precipitation or, if both are introduced, in what molar proportions.

The ratio of phase I to phase II is dependent upon the concentration of iodide in excess of that which can be accomodated within the limited iodide FCCRS crystal lattice phase that is present in the dispersing medium. The phase I:II ratio of silver forming the mixed phase zone can range from 99:1 (preferably 90:10 and optimally 80:20) to 10:90 (preferably 20:80 and optimally 50:50). The phase I:II ratios are those found in the completed emulsions. Somewhat higher proportions of phase II can be initially formed, since the proportion of phase II can, under appropriate conditions, such as extended holding at elevated temperatures conventionally used in emulsion precipitation and sensitization, be decreased to a desired final level.

By forming a mixed phase zone in which phase II is confined to discrete islands, the problems created by forming a shell consisting essentially of a high iodide composition are avoided. Development can proceed through the limited iodide continuous phase, allowing the discrete islands of high iodide phase II silver halide to be by-passed as development progresses through the mixed phase zone. The discrete islands can remain undeveloped or, if an adequate time period is allowed for total development, the discrete islands can be developed at a later stage in development. Even if substantial development of the discrete islands is contemplated, total development time is still much less than that required to develop a comparable percentage of total silver in latent image bearing grains containing a high iodide shell. Thus, the precipitation conditions are chosen to avoid the formation of a high iodide shell.

On the other hand, precipitation must also be controlled to either minimize or, preferably, eliminate formation of the phase II islands as a discrete grain population. If the phase II high iodide silver halide is precipitated as separate grains, short blue light absorption by these separate grains will occur, but translation of short blue light absorption into a readily developable latent image cannot be realized. In other words, the resulting emulsion is comparable to a blended emulsion in which a high iodide silver halide grain population is blended with conventional radiation-sensitive silver halide grains exhibiting only a limited iodide FCCRS crystal lattice structure. The high iodide grains absorb short blue light quite efficiently, but the short blue light absorption cannot be translated conveniently into a photographic image. The conventional, limited iodide grains are capable of producing a latent image that can be readily developed, but are unable to match the efficiency of the high iodide grains in short blue absorption.

As demonstrated in the Examples below, the preferred technique for producing the mixed phase zone is to undertake precipitation under controlled proximity to equilibrium conditions. That is, silver and halide ions are added at controlled rates to the dispersing medium in the reaction vessel with efficient mixing. Excessive levels of localized iodide supersaturation are thereby avoided that would otherwise result in grain renucleation as opposed to growth onto the silver halide already precipitated. The exact mechanism by which the phase II discrete islands are formed is not known, but it is believed that slowing the rate of precipitation (i.e., maintaining precipitation conditions nearer to equilibrium conditions) increases the size and number of the high iodide islands incorporated within the grains, other parameters remaining comparable.

Although precipitation in controlled proximity to equilibrium is demonstrated in the Examples, precipitations that are maintained very close to equilibrium conditions are not preferred, particularly in those instances in which a substantial proportion of total silver is contained in the core portions or shells of the grains and the iodide concentrations of these grain portions are relatively low in iodide. Under such conditions of precipitation the high iodide crystal lattice structure can be totally annealed out of the grains as shell precipitation progresses. That is, given enough time, iodide simply migrates from phase II to those limited iodide portions of the grain that are not at iodide saturation levels. The result can be the excessive reduction or even loss of the high iodide phase.

Further, it has been observed that a mixed phase zone cannot be precipitated at high levels of pAg. Instead of mixed phase zone sought, a separate high iodide phase grain population is formed by renucleation or no separate high iodide phase can be found in the final grain structure. For example, in precipitations at 80° C. and a pAg of greater than 8.70 microscopic examinations of grains taken at interim stages of precipitation reveal the formation of segregated high iodide epitaxy that subsequently disappears during shelling. The upper pAg boundary at other temperatures follows the same pAg versus temperature boundaries as shown in Piggin et al U.S. Pat. Nos. 5,061,616 and 5,061,609, Tsaur et al U.S. Pat. No. 5,252,453, and Delton U.S. Pat. Nos. 5,372,927 and 5,460,934, here incorporated by reference.

In the completed grains the iodide concentration in the continuous phase of the mixed phase zone can be well below saturation levels. For example, referring to FIG. 1, iodide concentrations can fall well below the IBr-ICl axis. Phase I iodide level reductions can occur during subsequent shelling of the mixed phase zone. For example, if a shell is formed by precipitating silver halide without any further iodide addition onto the mixed phase zone, a significant migration of iodide can occur from the continuous phase in the mixed phase zone to the shell as it is being formed. Thus, detectable levels of iodide can be present in the shell, even when no further iodide is introduced into the reaction vessel during formation of the shell, and the iodide concentration in the continuous phase of the mixed phase zone is correspondingly reduced. On the other hand, iodide ion migration from phase II islands can be relatively limited, since the silver iodide crystal lattice structure is as initially formed already at its minimum iodide level. Obviously, if conditions are readjusted between mixed zone precipitation and shell precipitation to lower axis BrI-ClI, this could contribute to some iodide migration from the phase II islands until a composition is reached corresponding to the new location of the BrI-ClI axis.

The description above is predicated on the shell precipitated on the mixed phase zone having a lower iodide concentration than continuous phase I. If it is desired to maintain the iodide level in continuous phase I at or near its level as initially formed, a shell can be precipitated on the mixed phase zone that has an iodide concentration at or near iodide saturation. For example, assuming FIG. 1 conditions, at or just below the IBr-ICl axis.

Usually it is not desired to have iodide levels at the surface of the grain at or near iodide saturation levels in an FCCRS crystal lattice structure. Accordingly, when a shell is provided on the mixed phase zone that is at or near the iodide saturation level in an FCCRS crystal lattice structure, it is preferred that a second overlying shell be provided to space the higher iodide shell from the surface of the grain. As an alternative, it is contemplated to decrease iodide addition progressively as shell precipitation over the mixed phase zone progresses, producing a shell with iodide concentrations grading downwardly from the mixed phase zone to the surface of the grain.

It is conventional practice to employ high bromide grains to achieve the highest attainable levels of imaging efficiency and photographic speed. Although chloride concentrations of up to about 30 mole percent, based on silver, can be tolerated with minimal impact on imaging efficiency and at concentrations of less than 10 mole percent, based on silver, actually improve overall performance properties, in most instances high bromide emulsions having the highest attainable imaging efficiency contain radiation-sensitive silver iodobromide grains.

Just as iodide at the surface of high bromide grains slows development rates, chloride at the surface of high bromide grains can be used to accelerate development rates, particularly at the onset of development. It is specifically contemplated to precipitate silver bromide alone for formation of the core portions and surface shell portions of the grains, with any iodide present in the completed grains being received by migration from the mixed phase zone. Silver bromide core portions are particularly advantageous in preparing tabular grain emulsions, since silver bromide is more easily grown into tabular form than other limited iodide silver halide compositions.

Instead of employing a silver iodobromide shell that is saturated in iodide to maintain iodide levels at or near saturation in a high bromide continuous phase of a mixed phase zone, it is specifically contemplated to increase the chloride concentration of the shell to limit iodide migration from the mixed phase zone. The lower saturation level of iodide in silver chloride acts to limit migration of iodide from the silver iodobromide continuous phase of the mixed phase zone. For example, compare the iodide levels of ICl and IBr in FIG. 1.

Apart from the features specifically disclosed the emulsions of the invention can take any convenient conventional form. Conventional features of radiation-sensitive silver iodohalilde emulsions are summarized in *Research Disclosure,* Item 36544, cited above. Among conventional emulsion preparation techniques specifically contemplated to be compatible with the present invention are those disclosed in Item 36544, I. Emulsion grains and their preparation, A. Grain halide composition, paragraph (5); C. Precipitation procedures; and D. Grain modifying conditions and adjustments, paragraphs (1) and (6).

Subsequent to their precipitation the emulsions of the invention can be prepared for photographic use as described by *Research Disclosure,* 36544, cited above, I. Emulsion grains and their preparation, E. Blends, layers and performance categories; II. Vehicles, vehicle extenders, vehicle-like addenda and vehicle related addenda; III. Emulsion washing; IV. Chemical sensitization; and V. Spectral sensitization and desensitization, A. Spectral sensitizing dyes.

The emulsions or the photographic elements in which they are incorporated can additionally include one or more of the following features illustrated by *Research Disclosure,* Item 36544, cited above: VII. Antifoggants and stabilizers; VIII. Absorbing and scattering materials; IX. Coating physical property modifying addenda; X. Dye image formers and modifiers; XI. Layers and layer arrangements; XII. Features applicable only to color negative; XIII. Features applicable only to color positive; XIV. Scan facilitating features; and XV. Supports.

The exposure and processing of photographic elements incorporating the emulsions of the invention can take any convenient conventional form, illustrated by *Research Disclosure,* Item 36544, cited above, XVI. Exposure; XVIII. Chemical development systems; XIX. Development; and XX. Desilvering, washing, rinsing and stabilizing.

EXAMPLES

The invention can be better appreciated by reference to the following specific embodiments. Comparative emulsions are designated with a "CE" prefix and emulsions satisfying invention requirements are designated with an "IE" prefix.

Example 1

This example demonstrates the preparation and performance of tabular grain emulsions satisfying invention requirements and similar conventional tabular grain emulsions lacking the internal mixed zone required by the invention.

Emulsion CE-1

The following solutions were prepared for the precipitation of comparative emulsion CE-1:

| | |
|---|---|
| Solution A-1 | |
| 22.5 gm bone gelatin | |
| 48.1 gm sodium bromide | |
| 1.5 mL antifoamant | |
| 4.5 L distilled water | |
| Solution B-1 | Solution C-1 |
| 1.25M silver nitrate | 1.36M sodium bromide |
| Solution D-1 | |
| 200 gm bone gelatin | |
| 3.5 L distilled water | |
| Solution E-1 | Solution F-1 |
| 0.98M sodium bromide | 104 gm sodium bromide |
| 0.27M potassium iodide | 600 gm distilled water |
| Solution G-1 | Solution H-1 |
| 2.50M silver nitrate | 2.71M sodium bromide |

To solution A-1 at 65° C., pH 5.9, and pAg 9.5 were added with vigorous stirring solutions B-1 and C-1 over a period of 1 minute precipitating 0.04 mole of silver bromide. The temperature was then ramped to 80° C. over a span of 9 minutes. Solution D-1 was then added and held for 2 minutes. Solutions B-1 and C-1 were added by double jet addition utilizing accelerated flow for 7.2 minutes while maintaining the pAg at 8.8 and consuming 4.5% of the total silver used. The same solutions were then added by double jet addition using decelerated flow over 14 minutes while adjusting the pAg to 7.1 and precipitating an additional 7.6% of the total silver. Solutions B-1 and E-1 were added at the existing pAg by double jet addition utilizing accelerated flow over 72 minutes while precipitating 19.5% of the total silver. Solution C-1 then replaced solution E-1 for the next 14.6 minutes precipitating another 8% of the total silver. The pAg was then adjusted back to 8.8 with solution F-1. Finally, solutions G-1 and H-1 were added to the element by accelerated flow over 29 minutes. The emulsion was then cooled and desalted. Approximately 10 moles of silver were used to prepare the emulsion.

The resultant tabular grain emulsion had an average grain ECD of 1.69 μm and a mean thickness of 0.37 μm. Tabular grains accounted for more than 90% of the total grain projected area. The overall iodide concentration was 4.3M %, based on total silver.

Emulsion CE-2

This emulsion example was made identically to emulsion CE-1, except that solution E-2 was substituted for solution E-1.

| Solution E-2 |
|---|
| 0.88M sodium bromide<br>0.38M potassium iodide |

The resultant tabular grain emulsion had an average grain ECD of 1.85 μm and a mean thickness of 0.35 μm. Tabular grains accounted for more than 90% of the total grain projected area. The overall iodide concentration was 6.0M %, based on total silver.

Emulsion CE-3

This emulsion was prepared by a procedure of the type taught by Karthhäuser German OLS 4,227,027 A1.

The following solutions were prepared for the precipitation of comparative emulsion CE-3.

| | |
|---|---|
| Solution A-3 | |
| 25.0 gm bone gelatin<br>44.8 gm sodium bromide<br>1.5 mL antifoamant<br>5.0 L distilled water | |
| Soution B-3 | Solution C-3 |
| 2.50M silver nitrate | 2.71M sodium bromide |
| Solution D-3 | Solution E-3 |
| 5 mL of 30 weight % ammonia | 200 gm bone gelatin<br>2.4 L distilled water |
| Solution F-3 | |
| 0.33M sodium bromide<br>0.67M potassium iodide | |

To solution A-3 at 65° C., pH 5.9, and pAg 9.45 were added with vigorous stirring solutions B-3 and C-3 over a period of 1 minute precipitating 0.06 mole of silver bromide. Solution D-3 was added and held for 5 minutes. Solution E-3 was added and the pH was adjusted to 6.0 over 4 minutes. The temperature was raised to 80° C. over a span of 9 minutes. Solutions B-3 and C-3 were added by double jet addition utilizing accelerated flow for 13.8 minutes while maintaining the pAg at 8.8 and consuming 11.4% of the total silver used. Solutions B-3 and F-3 were added at the existing pAg by double jet addition utilizing accelerated flow over 26.8 minutes while precipitating 20.2% of the total silver. Solution C-3 then replaced solution F-3 for the next 30 minutes precipitating another 57.5% of the total silver. Finally, solutions B-3 and C-3 were added to the element utilizing decelerated flow over 12 minutes while adjusting the pAg to 7.8. The emulsion was then cooled and desalted. Approximately 12 moles of silver were used to prepare the emulsion.

The resultant tabular grain emulsion had an average grain ECD of 1.85 μm and a mean thickness of 0.30 μm. Tabular grains accounted for more than 90% of the total grain projected area. The overall iodide concentration was 13.0% iodide, based on total silver.

Emulsion CE-4

This emulsion was prepared utilizing the same solutions as emulsion CE-1, except that solution E-4 was substituted for solution E-1 and minor modifications were made to the procedure, described below.

| Solution E-4 |
|---|
| 0.75M sodium bromide<br>0.50M potassium iodide |

To solution A-1 at 65° C., pH 5.9, and pAg 9.5 were added with vigorous stirring solutions B-1 and C-1 over a period of 1 minute precipitating 0.04 mole of silver bromide. The temperature was then ramped to 80° C. over a span of 9 minutes. Solution D-1 was then added and held for 2 minutes. Solutions B-1 and C-1 were added by double jet addition utilizing accelerated flow for 7.2 minutes while maintaining the pAg at 8.8 and consuming 4.2% of the total silver used. The same solutions were then added by double jet addition using decelerated flow over 9 minutes while adjusting the pAg to 7.1 and precipitating an additional 5.2% of the total silver. Solutions B-1 and E-4 were added at the existing pAg by double jet addition utilizing accelerated flow over 103 minutes while precipitating 32.5% of the total silver. Solution C-1 then replaced solution E-4 for the next 27.8 minutes precipitating another 18.8% of the total silver. The pAg was then adjusted back to 8.8 with solution F-1. Finally, solutions G-1 and H-1 were added to the element by accelerated flow over 19 minutes. The emulsion was then cooled and desalted. Approximately 10 moles of silver were used to prepare the emulsion.

The resultant tabular emulsion had an average grain diameter of 1.90 μm and a mean thickness of 0.35 μm. Tabular grains accounted for more than 90% of the total grain projected area. The overall iodide concentration was 13.0M %, based on total silver.

Emulsion IE-5

This emulsion was prepared utilizing the same solutions as emulsion CE-1, except that solution E-5 was substituted for solution E-1 and minor modifications were made to the procedure, described below.

| Solution E-5 |
|---|
| 0.33M sodium bromide<br>0.67M potassium iodide |

To solution A-1 at 65° C., pH 5.9, and pAg 9.5 were added with vigorous stirring solutions B-1 and C-1 over a period of 1 minute precipitating 0.04 mole of silver bromide. The temperature was then ramped to 80° C. over a span of 9 minutes. Solution D-1 was then added and held for 2 minutes. Solutions B-1 and C-1 were added by double jet addition utilizing accelerated flow for 7.2 minutes while maintaining the pAg at 8.8 and consuming 4.5% of the total silver used. The same solutions were then added by double jet addition using decelerated flow over 14 minutes while adjusting the pAg to 7.1 and precipitating an additional 7.6% of the total silver. Solutions B-1 and E-5 were added at the existing pAg by double jet addition utilizing accelerated flow over 72 minutes while precipitating 19.5% of the total silver. Solution C-1 then replaced solution E-5 for the next 14.6 minutes precipitating another 8% of the total silver. The pAg was then adjusted back to 8.8 with solution F-1. Finally, solutions G-1 and H-1 were added to the element by accelerated flow over 29 minutes. The emulsion was then cooled and desalted. Approximately 10 moles of silver were used to prepare the emulsion.

The resultant tabular emulsion had an average grain diameter of 1.84 μm and a mean thickness of 0.35 μm. Tabular grains accounted for more than 90% of the total grain projected area. The overall iodide concentration was 13.0%, based on total silver.

Emulsion IE-6 Invention

This emulsion was prepared utilizing the same solutions as emulsion IE-5. Minor modifications were made to the procedure, described below.

To solution A-1 at 65° C., pH 5.9, and pAg 9.5 were added with vigorous stirring solutions B-1 and C-1 over a period of 1 minute precipitating 0.04 moles of silver bromide. The temperature was then ramped to 80° C. over a span of 9 minutes. Solution D-1 was then added and held for 2 minutes. Solutions B-1 and C-1 were added by double jet addition utilizing accelerated flow for 7.2 minutes while maintaining the pAg at 8.8 and consuming 4.5% of the total silver used. The same solutions were then added by double jet addition using decelerated flow over 14 minutes while adjusting the pAg to 7.1 and precipitating an additional 7.6% of the total silver. Solutions B-1 and E-5 were added at the existing pAg by double jet addition utilizing accelerated flow over 42 minutes while precipitating 9.8% of the total silver. Solution C-1 then replaced solution E-5 for the next 16.2 minutes precipitating another 8% of the total silver. The pAg was then adjusted back to 8.8 with solution F-1. Finally, solutions G-1 and H-1 were added to the element by accelerated flow over 35 minutes. The emulsion was then cooled and desalted. Approximately 10 moles of silver were used to prepare the emulsion.

The resultant tabular emulsion had an average grain diameter of 1.91 μm and a mean thickness of 0.36 μm. Tabular grains accounted for more than 90% of the total grain projected area. The bulk iodide was 6.5% iodide based on the total silver.

Emulsion IE-7

This emulsion was prepared utilizing the same solutions as emulsion IE-5, except that solution E-7 was substituted for solution E-5.

| Solution E-7 |
|---|
| 0.10M sodium bromide<br>0.90M potassium iodide |

The resultant tabular grain emulsion had an average grain ECD of 1.92 μm and a mean thickness of 0.32 μm. Tabular grains accounted for more than 90% of the total grain projected area. The overall iodide concentration was 17.6M %, based on total silver.

Emulsion IE-8

This emulsion was prepared utilizing the same solutions as emulsion IE-5, except that additional solution I-8 was prepared and the procedure was modified as outlined below.

| Solution I-8 |
|---|
| 46 gm potassium chloride<br>180 gm distilled water |

To solution A-1 at 65° C., pH 5.9, and pAg 9.5 were added with vigorous stirring solutions B-1 and C-1 over a period of 1 minute precipitating 0.04 mole of silver bromide. The temperature was then ramped to 80° C. over a span of 9 minutes. Solution D-1 was then added and held for 2 minutes. Solutions B-1 and C-1 were added by double jet addition utilizing accelerated flow for 7.2 minutes while maintaining the pAg at 8.8 and consuming 4.5% of the total silver used. The same solutions were then added by double jet addition using decelerated flow over 14 minutes while adjusting the pAg to 7.1 and precipitating an additional 7.6% of the total silver. Solution I-8 was added to the vessel over 2 minutes with vigorous stirring. Solutions B-1 and E-5 were added at the existing pAg by double jet addition utilizing accelerated flow over 72 minutes while precipitating 19.5% of the total silver. Solution C-1 then replaced solution E-5 for the next 14.6 minutes precipitating another 8% of the total silver. The pAg was then adjusted back to 8.8 with solution F-1. Finally, solutions G-1 and H-1 were added to the element by accelerated flow over 29 minutes. The emulsion was then cooled and desalted. Approximately 10 moles of silver were used to prepare the emulsion.

The resultant tabular grain emulsion had an average grain ECD of 1.61 μm and a mean thickness of 0.44 μm. Tabular grains accounted for more than 90% of the total grain projected area. The emulsion was analyzed by neutron activation to contain 12.1M % iodide, 3.6M % chloride, and 84.3M % bromide, based on total silver.

Sensitometric Evaluation

The emulsions were each optimally sensitized with sodium thiocyanate, sodium thiosulfate pentahydrate, sodium aurous dithiosulfate dihydrate, Compound 1, and spectrally sensitized with Dye A (blue light peak wavelength absorption at 470 nm). The emulsions were blended with Compound 2 and a yellow dye forming coupler and coated on a photographic film support at a silver coverage of 8.6 $mg/dm^2$.

Compound 1 3-(2-methylsulfamoylethyl)-benzothiazolium tetrafluoroborate

Dye A Anhydro-5,5-dichloro-3,3'-bis(3-sulfopropyl) thiacarbocyanine hydroxide, triethylamine Compound 2 4-hydroxy-6-methyl-1,3,3a,7-tetraazaindene, sodium salt The coatings were exposed through a step wedge and Kodak Wratten™ 2B filter to daylight at a color temperature of 5500° K. for 0.01 second, followed by development for 3 minutes 15 seconds using the Kodak Flexicolor™ C-41 process.

The photographic coatings were evaluated for speed and gamma. Speed is reported in relative log units, where a difference in speed of 1 unit is equal to 0.01 log E, where E represents exposure in lux-seconds. Speed was measured at a toe density of $D_s$ where $D_s$ minus $D_{min}$ equals 20 percent of the slope of a line dram between $D_s$ and a point $D_p$ on the characteristic curve offset from $D_s$ by 0.6 log E. Gamma is reported as the calculated slope of the linear portion of the characteristic curve midway between the maximum and minimum densities.

The same coatings were also analyzed with a Diano Matchscan II™ spectrophotometer manufactured by the Milton Roy Co. The optical absorption spectra were evaluated for absorption attributable to silver iodide by drawing a straight line between absorptances at 400 and 440 nm. Intermediate absorptances significantly higher than predicted by linear interpolation demonstrated a contribution to absorptance by a high iodide phase, known to exhibit an absorption peak in the vicinity of 425 nm.

A summary of sensitometric observations is shown in Table I.

TABLE I

| Emulsion | I M % | High I phase? | Relative speed | Gamma |
|---|---|---|---|---|
| CE-1 | 4.3 | no | 100 | 1.72 |
| CE-2 | 6.0 | no | 102 | 1.52 |
| CE-3 | 13.0 | no | 98 | 1.06 |
| CE-4 | 13.0 | no | 99 | 1.20 |
| IE-5 | 13.0 | yes | 109 | 1.31 |
| IE-6 | 6.5 | yes | 110 | 1.55 |
| IE-7 | 17.6 | yes | 114 | 0.88 |
| IE-8 | 12.1 | yes | 111 | 1.35 |

From Table I it is apparent that the photographic speed of the emulsions satisfying invention requirements were superior to that of the comparative emulsions. In addition, at equal iodide content the emulsions of the invention displayed superior photographic gamma. The higher gamma was the result of locally concentrating iodide in discrete islands within the mixed phase zone, which improved development of the emulsion grains. The high iodide phase in the mixed phase zone also increased absorption in the =425 nm spectral region.

Observation of Grain Features

Figure 4:
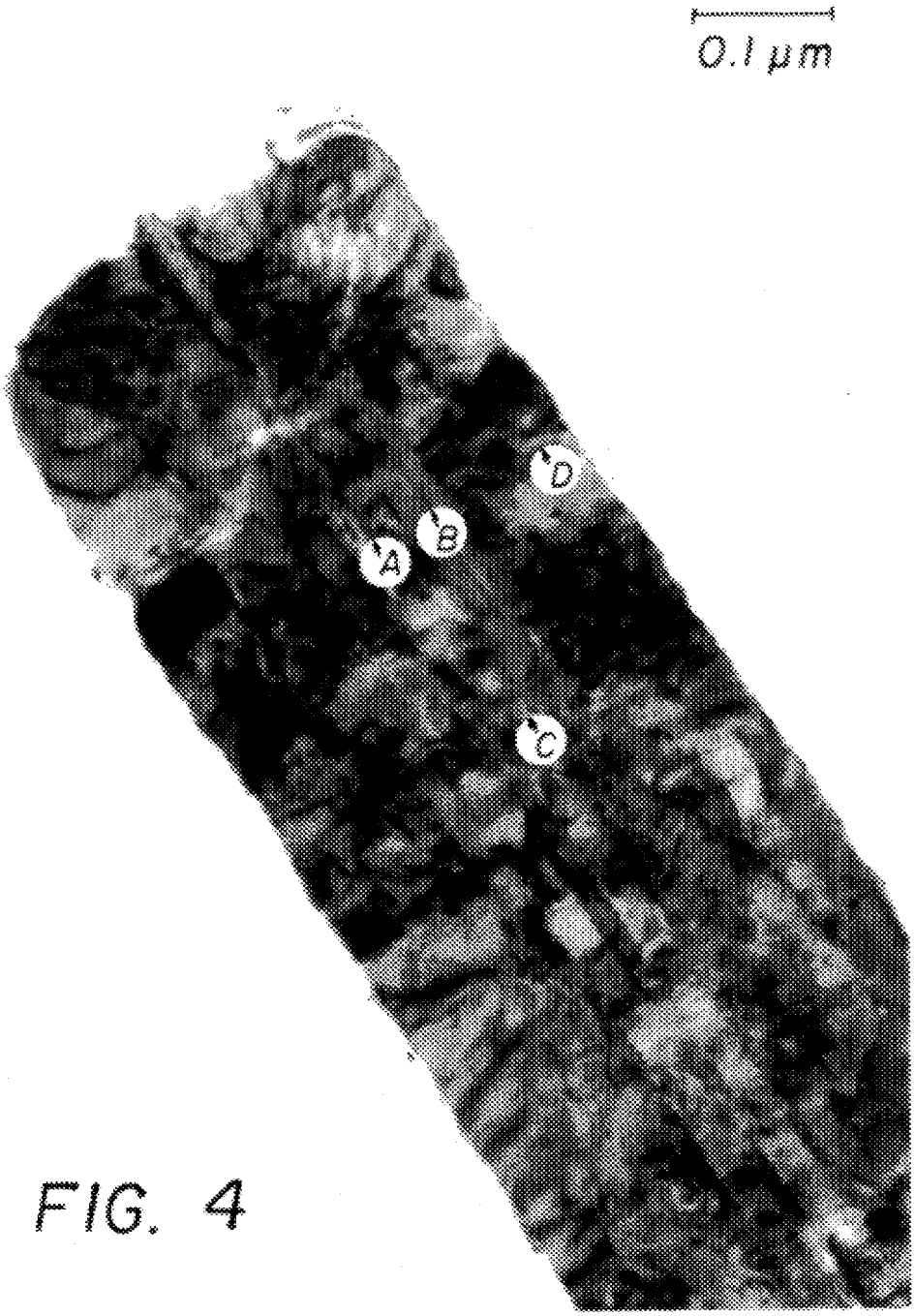
FIG. 4 is an enlarged fragmentary view of a sectioned tabular silver halide grain satisfying the requirements of the invention.

To demonstrate the presence of a mixed phase zone within the tabular grains of emulsions satisfying invention requirements, the following analysis is provided:

In FIG. 4 a micrograph of a sectioned sample tabular grain taken from Emulsion IE-5 is shown. Locations A, B, C and D on the sectioned grain were examined by analytical electron microscopy. Electrons directed at the sample at the spots indicated produced X-ray spectra. From the spectral location of the X-ray emission peaks the presence of iodide and bromide in the spot area was ascertained and from the relative amplitude of the emission peaks indicative of iodide and bromide the proportions of the two halides were determined.

The bromide and iodide concentrations within the spots as a mole percent, based on silver, is shown in Table II.

TABLE II

| Spot | Br (M %) | I (M %) |
|---|---|---|
| A | 98,5 | 1.5 |
| B | 10.0 | 90.0 |
| C | 71.0 | 29.0 |
| D | 93.3 | 6.7 |

Spot A is located in the twin plane area of the tabular grain. At the time this portion of the grain was precipitated no iodide was present. One possible explanation of the 1.5M % iodide observed is that iodide was spread into this area in the course of sectioning the tabular grain.

Spot B is located in one of the discrete islands within the mixed phase zone. The island appears as a region of narrow parallel lines parallel to the twin planes of the tabular grain. The 90M % iodide concentration confirms the existence of a silver iodide crystal lattice structure at this location.

Spot C is located in the continuous phase of the mixed phase zone surrounding the high iodide islands.

Spot D is located in the low iodide shell portion of the tabular grain.

Example 2

This set of emulsions was composed of monodisperse octahedra matched in grain size and iodide content. Emulsions CE-10, CE-11, and IE-12 were precipitated from the common seed grain emulsion SE-9. Emulsions CE-10 and CE-11 were precipitated by procedures similar to those disclosed by Sugimoto et al U.S. Pat. No. 4,614,711.

Emulsion SE-9

The following solutions were prepared for the precipitation of the seed emulsion:

| Solution A-9 | Solution B-9 |
|---|---|
| 150 gm bone gelatin<br>40 gm potassium bromide<br>5 L distilled water | 0.4 gm Compound 3<br>400 gm methanol |
| **Solution C-9** | **Solution D-9** |
| 1.47M silver nitrate | 1.73M potassium bromide<br>0.03M potassium iodide |
| **Solution E-9** | |
| 276 gm bone gelatin | |

Compound 3: 3,4-dimethyl-4-thiazoline-2-thione

Solution B-9 was added to solution A-9 at 75° C., pH 5.8, and pAg 8.87. With vigorous stirring, solutions C-9 and D-9 were added by double jet addition utilizing accelerated flow for 77.5 minutes while maintaining the pAg at 8.87. Solution E-9 was added, after which the emulsion was cooled and chill set. Approximately 5.94 moles of silver were used to prepare the emulsion.

The resultant silver halide particles were monodisperse octahedral silver iodobromide grains having a mean ECD 1.12 μm. The emulsion was uniform in composition containing 2M % iodide, based on total silver.

Emulsion CE-10

The following solutions were prepared for the precipitation of comparative emulsion CE-10:

| | |
|---|---|
| Solution A-10 | |
| 1.6 mol seed emulsion SE-9<br>12.4 gm potassium bromide<br>1.4 L distilled water | |
| Solution B-10 | Solution C-10 |
| 1.0M silver nitrate | 1.09M potassium bromide |
| Solution D-10 | |
| 0.36M potassium iodide | |

To solution A-10 at 75° C., pH 5.8 and pAg 8.87 was added solution B-9. With vigorous stirring, solution D-10 was added over 10 minutes at a flowrate of 100 cc/min. Solutions B-10 and C-10 were added by the double jet technique at a constant flow rate for 10 minutes while controlling the pAg at 8.87 and precipitating 1.6% of the total silver. The same solutions were then added by double jet addition utilizing accelerated flow for 95.6 minutes. The emulsion was then cooled and desalted. Approximately 6 moles of silver were used to prepare the emulsion.

The resultant silver halide emulsion particles were monodisperse octahedral silver iodobromide grains. The measured mean ECD of the emulsion grains was 1.76 μm. The emulsion contained 6.2M % overall iodide, based on total silver.

Emulsion CE-11

The following solutions were prepared for the precipitation of comparative emulsion CE-11.

| | |
|---|---|
| Solution A-11 | |
| 1.6 mol seed emulsion SE-9<br>12.4 gm potassium bromide<br>1.4 L distilled water | |
| Solution B-11 | Solution C-11 |
| 1.0M silver nitrate | 1.09M potassium bromide |
| Solution D-11 | Solution E-11 |
| 0.36M potassium iodide | 0.36M silver nitrate |

To solution A-11 at 75° C., pH 5.8 and pAg 8.87 was added solution B-9. With vigorous stirring, solutions D-11 and E-11 were added at a constant flowrate over 10 minutes while controlling the pAg at 8.87 and precipitating 5.7% of the total silver. Solutions B-11 and C-11 were added by the double jet technique at a constant flowrate for 10 minutes while controlling the pAg at 8.87 and precipitating an additional 1.6% of the total silver. The same solutions were then added by double jet addition utilizing accelerated flow for 95.6 minutes. The emulsion was then cooled and desalted. Approximately 6 moles of silver were used to prepare the emulsion.

The resultant silver halide emulsion particles were monodisperse octahedral silver iodobromide grains. The measured mean ECD of the grains was 1.80 μm. The emulsion contained 6.2M % iodide overall, based on total silver.

Emulsion IE-12

The following solutions were prepared for the precipitation of inventive emulsion IE-11:

| | |
|---|---|
| Solution A-12 | |
| 1.6 mol seed emulsion CE-9<br>12.4 gm potassium bromide<br>1.4 L distilled water | |
| Solution B-12 | Solution C-12 |
| 1.0M silver nitrate | 1.09M potassium bromide |
| Solution D-12 | Solution E-12 |
| 0.24M potassium iodide<br>0.12M potassium bromide | 0.36M silver nitrate |

To solution A-12 at 75° C., pH 5.8 and pAg 8.87 was added with vigorous stirring solution E-12 at a constant flowrate over 22 minutes while controlling the pAg at 7.1 and precipitating 4.1% of the total silver. Solutions D-12 and E-12 were added by double jet utilizing accelerated flow for 67 minutes while controlling the pAg at 7.2 and precipitating an additional 8.5% of the total silver. Solutions B-12 and C-12 were then added by double jet addition utilizing accelerated flow for 34 minutes and precipitating 8% of the total silver. Solution C-12 was added to adjust the pAg to 8.8. Solutions B-12 and C-12 were then added by double jet addition utilizing accelerated flow over 58 minutes. The emulsion was then cooled and desalted. Approximately 6 moles of silver were used to prepare the emulsion.

The resultant silver halide emulsion particles were monodisperse octahedral silver iodobromoide grains. The measured mean projected ECD of the grains was 1.69 μm. The emulsion contained 6.2M % iodide overall, based on total silver.

Sensitometric Evaluation

The emulsions were each optimally sensitized with sodium thiocyanate, sodium thiosulfate pentahydrate, sodium aurous dithiosulfate dihydrate, and Compound 1. The emulsions were blended with Compound 2 and a yellow dye forming coupler and coated on a photographic film support at a silver coverage of 8.6 mg/dm$^2$.

The coatings were exposed through a step wedge and Kodak Wratten™ 2B filter to daylight at a color temperature of 5500° K. for 0.01 second, followed by development for 3 minutes 15 seconds using the Kodak Flexicolor™ C-41 process. Speed and gamma were measured as in Example 1.

Unsensitized melts of emulsions CE-10, CE-11, and IE-12 were coated at a silver coverage of 32.2 mg/dm$^2$ and analyzed with a Diano Matchscan II™ spectrophotometer manufactured by the Milton Roy Co. The optical absorption spectra were evaluated for absorbance at 420 nm.

The absorption and sensitometric results are summarized in Table III.

TABLE III

| Emulsion | % Abs. @ 420 nm | Relative Speed | Gamma |
|---|---|---|---|
| CE-10 | 0.543 | 100 | 0.45 |
| CE-11 | 0.530 | 99 | 0.46 |
| IE-12 | 0.580 | 117 | 0.65 |

Although all three emulsions contained the same amount of total iodide (6.2 mole percent, based on total silver), only inventive emulsion IE-12 contained an internal heterogeneous mixed phase zone. The significantly higher absorption of light at 420 nm for emulsion IE-12 is indicative of this unique feature. In addition, emulsion IE-12 demonstrated significantly higher photographic speed and gamma. The higher gamma was the result of locally concentrating iodide in discrete islands within the mixed phase zone, which improved development of the emulsion grains.

The invention has been described in detail with particular reference to preferred embodiments thereof, but it will be understood that variations and modifications can be effected within the spirit and scope of the invention.

What is claimed is:

1. A photographic emulsion comprised of a dispersing medium and silver halide grains wherein, at least half of total silver forming the grains is accounted for by radiation-sensitive silver halide grains containing a continuous silver halide phase of a face centered cubic rock salt crystal lattice structure and a discontinuous phase in the form of discrete islands separated by and surrounded by the continuous phase, each of the islands exhibiting a silver iodide crystal lattice structure.

2. A photographic emulsion according to claim 1 wherein the continuous phase forming radiation-sensitive grains form a surface shell having a thickness of at least 25 Angstroms from which the discontinuous phase is absent.

3. A photographic emulsion according to claim 2 wherein the surface shell has a thickness of at least 50 Angstroms.

4. A photographic emulsion according to claim 2 wherein the surface shell contains a lower concentration of iodide than any zone within the radiation-sensitive grains containing both the continuous and discontinuous phases.

5. A photographic emulsion according to any one of claims 1 to 4 inclusive wherein the continuous phase forms a core portion of the radiation-sensitive grains from which the discontinuous phase is absent.

6. A photographic emulsion according to claim 5 wherein the core portion contains parallel twin planes.

7. A photographic emulsion according to claim 5 wherein the core portion contains a lower concentration of iodide than any zone within the radiation-sensitive grains containing both the continuous and discontinuous phases.

* * * * *